US006652275B2

(12) United States Patent
Byers

(10) Patent No.: US 6,652,275 B2
(45) Date of Patent: Nov. 25, 2003

(54) INTRA-ORAL ARTICLE FOR COSMETICALLY STRETCHING AND RECONFIGURING CHEEK SKIN AND METHOD FOR CUSTOMIZING SAME

(76) Inventor: Patricia H. Byers, 4940 60$^{th}$ Ave. South, St. Petersburg, FL (US) 33176

( * ) Notice: Subject to any disclaimer, the term of this patent is extended or adjusted under 35 U.S.C. 154(b) by 0 days.

(21) Appl. No.: 09/916,770

(22) Filed: Jul. 27, 2001

(65) Prior Publication Data

US 2003/0023313 A1 Jan. 30, 2003

(51) Int. Cl.$^{7}$ ..... A61C 5/00
(52) U.S. Cl. ..... 433/140
(58) Field of Search ..... 623/17.17, 17.18; 433/6, 136–139, 140

(56) References Cited

U.S. PATENT DOCUMENTS

| | | | | | |
|---|---|---|---|---|---|
| 4,239,037 | A | | 12/1980 | Fausone | |
| 4,580,980 | A | | 4/1986 | Acquanetta | |
| 4,657,509 | A | * | 4/1987 | Morris | 433/171 |
| 4,671,766 | A | * | 6/1987 | Norton | 433/6 |
| D290,877 | S | | 7/1987 | Giampapa et al. | |
| 4,894,012 | A | * | 1/1990 | Goldberg et al. | 260/998.11 |
| 4,900,552 | A | * | 2/1990 | Sanvordeker et al. | 424/422 |
| 4,920,984 | A | * | 5/1990 | Furumichi et al. | 128/861 |
| 4,957,480 | A | | 9/1990 | Morenings | |
| 4,969,901 | A | | 11/1990 | Binder | |
| 5,076,791 | A | | 12/1991 | Madray, Jr. | |
| 5,339,832 | A | | 8/1994 | Kittelsen et al. | |
| 5,431,610 | A | | 7/1995 | Miller | |
| 5,527,357 | A | | 6/1996 | Springer, Jr. | |
| 5,555,900 | A | | 9/1996 | Rich | |
| 5,556,357 | A | | 9/1996 | Hanna | |
| 5,616,027 | A | | 4/1997 | Jacobs et al. | |
| 5,718,575 | A | * | 2/1998 | Cross, III | 433/6 |
| 5,829,441 | A | | 11/1998 | Kidd et al. | |
| 5,951,291 | A | | 9/1999 | Albert et al. | |
| 5,975,893 | A | * | 11/1999 | Chishti et al. | 433/24 |
| 6,162,516 | A | * | 12/2000 | Derr | 428/35.2 |

* cited by examiner

*Primary Examiner*—Nicholas D. Lucchesi
*Assistant Examiner*—Fenn C Mathew
(74) *Attorney, Agent, or Firm*—Pendorf & Cutliff

(57) ABSTRACT

An intra-oral article that is user-customized from a contoured, thermoplastic pre-form stretches and reconfigures cheek skin, thereby diminishing the appearance of cheek lines, wrinkles, folds, and depressions. After heating a pre-form to its softening point, it is pressed against the buccal surface of the gums and teeth in a posterior quadrant of the maxilla or mandible. The pre-form is removed from the mouth after hardening, which yields a customized impression on the interior surface of the pre-form. The customized article can subsequently be applied and removed as desired by the user.

15 Claims, 2 Drawing Sheets

FIG. 1
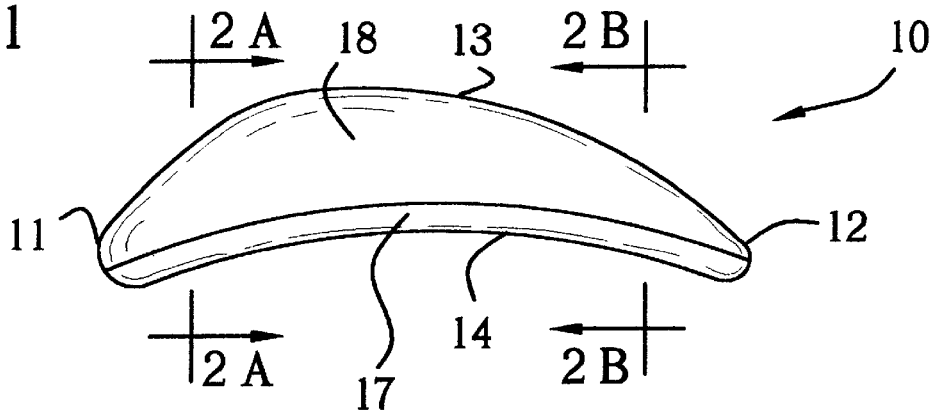
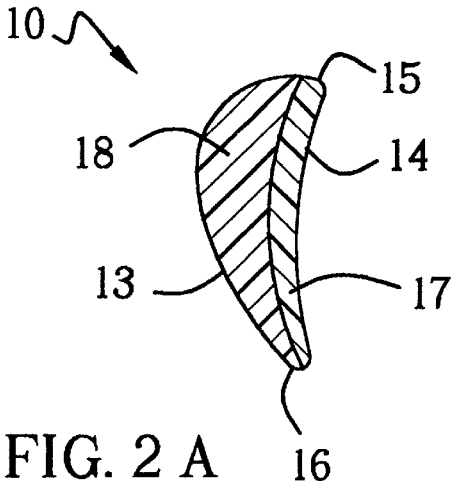
FIG. 2 A
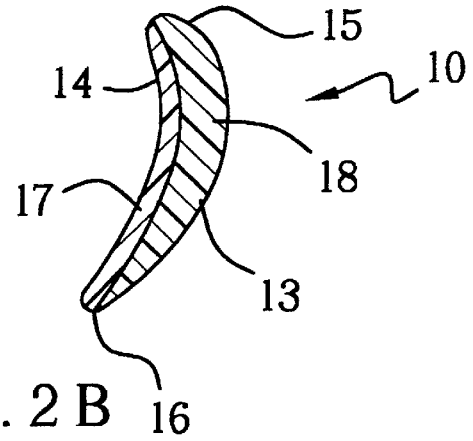
FIG. 2 B
FIG. 3
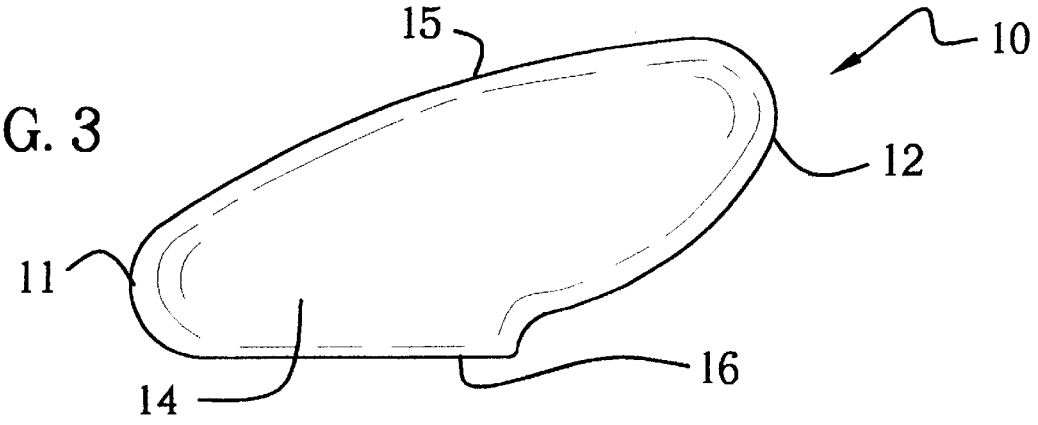

INTRA-ORAL ARTICLE FOR COSMETICALLY STRETCHING AND RECONFIGURING CHEEK SKIN AND METHOD FOR CUSTOMIZING SAME

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

The invention relates to an article for cosmetically stretching and reconfiguring skin. More particularly, the invention relates to a thermoplastic, removable, user-customizable pre-form for an intra-oral article to cosmetically stretch and reconfigure cheek skin and a method for customizing the pre-form.

In today's society, youth is a highly prized asset. The human face is an important element in projecting a youthful appearance, but it is always eventually subject to the effects of aging. More specifically, the external effects of aging on the cheeks include sagging, lines, wrinkles, folds, and depressions. Similarly, these effects may occur after extreme, rapid weight loss, or as a consequence of facial paralysis from health problems such as Bell's palsy or stroke. A broad range of approaches to ameliorate these effects is available to the millions of individuals who seek a more youthful or aesthetically pleasing appearance. Among these approaches are surgical and non-surgical facial procedures, facial muscle exercises, externally applied skin stretching appliances, denture modifications, and topically applied preparations.

According to the American Society of Plastic Surgeons, of the 1.3 million cosmetic plastic surgical procedures performed by board-certified plastic surgeons in 2000, three of the top five procedures were performed on the face. A 77% increase in facelifts from 1992 to 2000 were reported, with 70,882 performed in 2000 compared to 40,077 in 1992. Surgical approaches such as facelifts and cheek implants produce the most dramatic and enduring results. Examples of surgical implants that are used in the mid-facial or submalar region (cheek) of a person's face are shown in U.S. Pat. No. 4,969,901 and U.S. Design No. 290,877. Surgical methods are costly, require recovery time, may be painful, usually require more than local anesthesia, and postoperative complications may ensue. Among the complications associated with facelifts are visible scarring, injury to nerves that control facial muscles and sensation, and alteration of the hairline. Further, if the skin is pulled too tightly, the face may assume an unnatural appearance. Facial implants in the cheek are permanent, and are associated with complications that include infection and migration of the implant within the cheek. Further, excess scar tissue around a cheek implant may occur, causing the face to have an unnatural shape.

Less invasive procedures performed on cheeks such as laser and chemical resurfacing, fat implantation, intradermal collagen, liposuction, and dermabrasion are less costly, but the effects are more transitory, less pronounced, and repeat procedures are not uncommon. Despite the fact that a professional is required to render these services, the risk of complications still exists. Among these complications are scarring, abnormal changes in skin pigmentation, and allergic reactions.

With facial muscle exercise programs, the individual uses various devices to exercise muscles surrounding the mouth or other facial muscles. For example, U.S. Pat. No. 5,556,357 to Hanna and U.S. Pat. No. 5,431,610 to Miller teach such devices. Further, electrical muscle stimulators such as those shown in U.S. Pat. No. 4,957,480 to Morenings and U.S. Pat. No. 5,527,357 to Springer are each used to passively exercise facial muscles. No matter which exercise method is used, the exercises require time to perform, during which privacy may be desired. Improvement in cheek appearance varies, but regular, long-term performance of the exercises is necessary to maintain improvement.

Various types of headgear can be used to externally stretch cheek skin for cosmetic purposes. The headgear usually incorporates adhesive elements applied to the skin, upon which stretch tension is exerted. Examples of headgear devices are shown in U.S. Pat. No. 5,555,900 to Rich and U.S. Pat. No. 4,239,037 to Fausone. Despite inclusion of hairpieces or headbands, the equipment may be difficult to camouflage and is, therefore, typically used only by women. When using the headgear, adjusting the tension to achieve the desired effect may be laborious, time-consuming, and unable to be accomplished without assistance. The adhesive elements usually require replacement after use, and the skin is subject to epidermal stripping with repeated application to the same site.

Intra-oral stretching and reconfiguration of facial skin to produce a more youthful appearance by restructuring the gum portion of artificial upper dentures is also used. U.S. Pat. No. 4,580,980 to Acquanetta describes this type of procedure. The approach taught by Acquanetta is limited to edentulous individuals, is costly, and requires dental services.

Lastly, topical preparations such as lotions, creams and serums are directed toward minimizing the appearance of lines and wrinkles, some of which purport to firm and lift facial skin. These types of products vary widely in their efficacy and cost, improvement may not be immediately apparent, and reduction of cheek folds and depressions is negligible. Maintaining improvement derived from these products requires continuous use and long-term monetary commitment for recurring purchase. As aging progresses, effects of these products may diminish.

BRIEF SUMMARY OF THE INVENTION

The present invention is an intra-oral article that is user-customized from a contoured pre-form. The intra-oral article is made of one or more medical or food grade thermoplastic materials that are solid at, or below, body temperature. The pre-form has a generally concave interior that approximates the contour of a buccal surface of a posterior quadrant of a maxilla or mandible, and an exterior that is generally convex with respect to the concave interior. The pre-form has a predetermined length and height. Further, the pre-form has a predetermined width between the concave interior and the convex exterior.

The pre-form is heated until softened, pressed against the buccal surface of the gum and teeth in a posterior quadrant of the maxilla or mandible, and removed from the mouth after hardening. The interior surface of the pre-form thus bears an impression of a user's teeth and gum.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining the preferred embodiment of the invention in detail, it is to be understood that the phraseology and terminology employed herein are for the purpose of description and should not be regarded as limiting.

As such, those skilled in the art will appreciate that the conception, upon which this disclosure is based, may readily be utilized as a basis for the designing of non-invasive, intra-oral articles, methods and systems for carrying out the several purposes of the present invention. It is important, therefore, that the claims be regarded as including such equivalent constructions insofar as they do not depart from the spirit and scope of the present invention.

The object of the present invention is to utilize technology similar to dental technology to cosmetically improve aging effects on the face. Denture modification, as shown in Acquanetta's U.S. patent (U.S. Pat. No, 4,589,980), stands alone as a non-surgical, intra-oral approach to minimizing the facial effects of aging. This is not surprising, considering that this is not the chief concern in the field of dentistry.

It is the object of the present invention to have an intra-oral article that can be easily customized, and can be repeatedly heated and molded in the unlikely event a readjustment is necessary. When a customized pre-form is worn by a user, cheek skin is stretched and reconfigured, thereby diminishing the appearance of sagging, lines, wrinkles, folds, and depressions.

Once customized, it is a further object of the invention to have an intra-oral article that is quickly and easily applied and removed as desired by a user, with the full effect of the invention on the appearance of the cheek occurring immediately whenever it is applied, obviating the need for any maintenance activities.

An even further object of the present invention is to provide an intra-oral article that is durable, does not require the services of a dental professional, and is inexpensive compared to aforementioned approaches.

Still yet another object of the present invention is to enable the user to avoid the discomfort, risks, and recovery time associated with invasive procedures to improve cheek appearance.

Still another object of the present invention is to provide an intra-oral article that is self-contained in a posterior quadrant of the mouth, with no apparatus about the head that requires camouflaging, so that it can be utilized by both men and women.

Lastly, it is the object of the present invention to provide an intra-oral article that can be worn by individuals with and without artificial dentures.

Facial structure is rarely perfectly symmetrical, and aging or health effects on the cheeks may be more pronounced on one cheek than the other. The invention is available in several sizes, and can be worn in from one, to all four, posterior quadrants of the mouth. This feature provides users with the ability to customize the stretching and reconfiguration of cheek skin to achieve the user's desired appearance.

These, together with other objects of the invention, along with the various features of novelty, which characterize the invention, are pointed out with particularity in the claims annexed to, and forming a part of, this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF SEVERAL VIEWS OF THE DRAWINGS

The invention will be better understood and objects other than those set forth above will become apparent when consideration is given to the following detailed description thereof. Such description refers to the annexed drawings wherein:

FIG. 1 is a top view of the pre-form according to a preferred embodiment of the present invention FIG. 2A is a cross-sectional view of the pre-form of FIG. 1, taken through lines 2A—2A of FIG. 1

FIG. 2B is a cross-sectional view of the pre-form of FIG. 1, taken through lines 2B—2B of FIG. 1

FIG. 3 is a frontal view of the pre-form of FIG. 1, showing the interior surface thereof

DETAILED DESCRIPTION OF THE INVENTION

Figure 4:
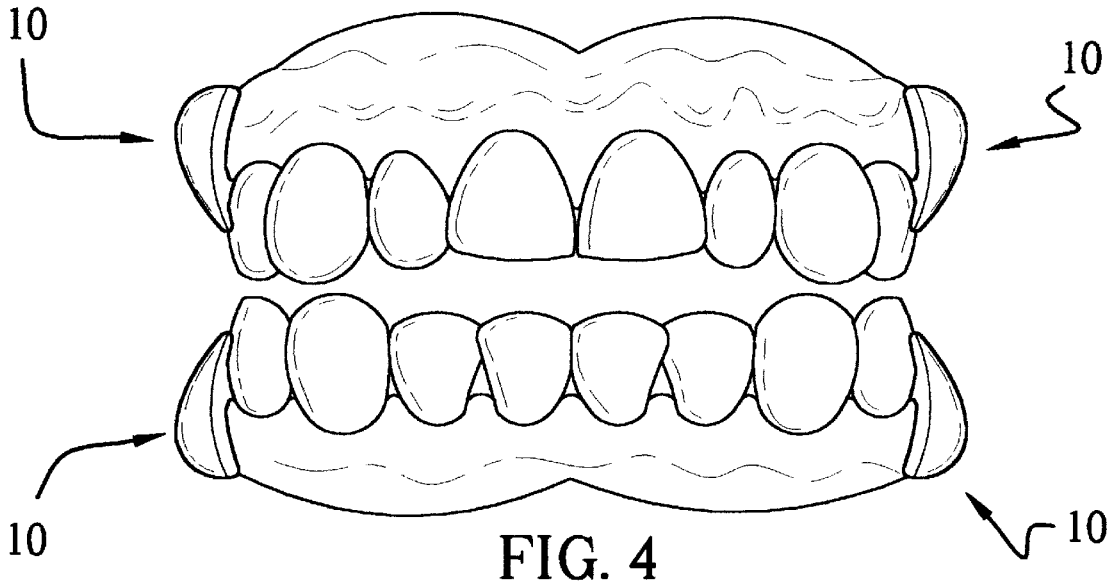
FIG. 4 is a frontal view of a human maxilla and mandible, showing a pre-form as set out in FIG. 1, on the buccal surface of each posterior quadrant

With reference now to the drawings, and in particular to FIGS. 1–5 thereof, the pre-form for the intra-oral article, as generally designated by the reference numeral 10, will be described.

A preferred embodiment of the present invention, as shown in FIGS. 1, 2A, and 2B, is bi-layered and has a generally crescent or arcuate shape, with a uniform, concave interior 14 shaped to approximate the buccal curvature of a posterior quadrant of the maxilla or mandible.

More specifically, the top view of the pre-form 10 in FIG. 1 shows that, horizontally, the convex exterior 13 roundly tapers to anterior 12 and posterior 11 borders, with the pre-form 10 having a greater diameter posteriorly 11 than anteriorly 12. Further, FIGS. 2A and 2B illustrate that, vertically, the diameter of the pre-form 10 is greater superiorly 15 than inferiorly 16.

As best shown in FIG. 3, the frontal view of the pre-form's 10 interior surface 14 shows the pre-form 10 to have a relatively straight inferior border 16. The superior border 15 curves upward anteriorly 12 to approximate the contour of the oral vestibule at the mucobuccal fold in a posterior quadrant of the maxilla or mandible. The anterior end 12 of the superior border 15 curves gradually inward as it descends toward the inferior border 16, then straightens to continue in approximately perpendicular fashion to the inferior border 16. Furthermore, as seen in FIGS. 1, 2A and 2B, the pre-form has a width that is smaller at the anterior and posterior edges than between the anterior and posterior edges.

Referring now to FIG. 4, wherein the placement of the pre-form 10 in an individual's mouth is shown. Specifically, during use, the user positions a pre-form 10 over the buccal surface in the two maxillary (upper) and two mandibular (lower) posterior quadrants on the right or left side of the mouth. It is to be noted that the user is not required to use four pre-forms 10 to stretch and reconfigure the skin of the cheek for cosmeticizing. The user may choose to use from one to four pre-forms 10 to produce the user's desired results. Further, the two maxillary pre-forms 10 are reverse images of each other, as are the two mandibular pre-forms 10. Pre-forms 10 in diagonally opposed quadrants are identical. Thus, two configurations of the pre-forms 10 suffice for all four posterior quadrants.

Figure 5:
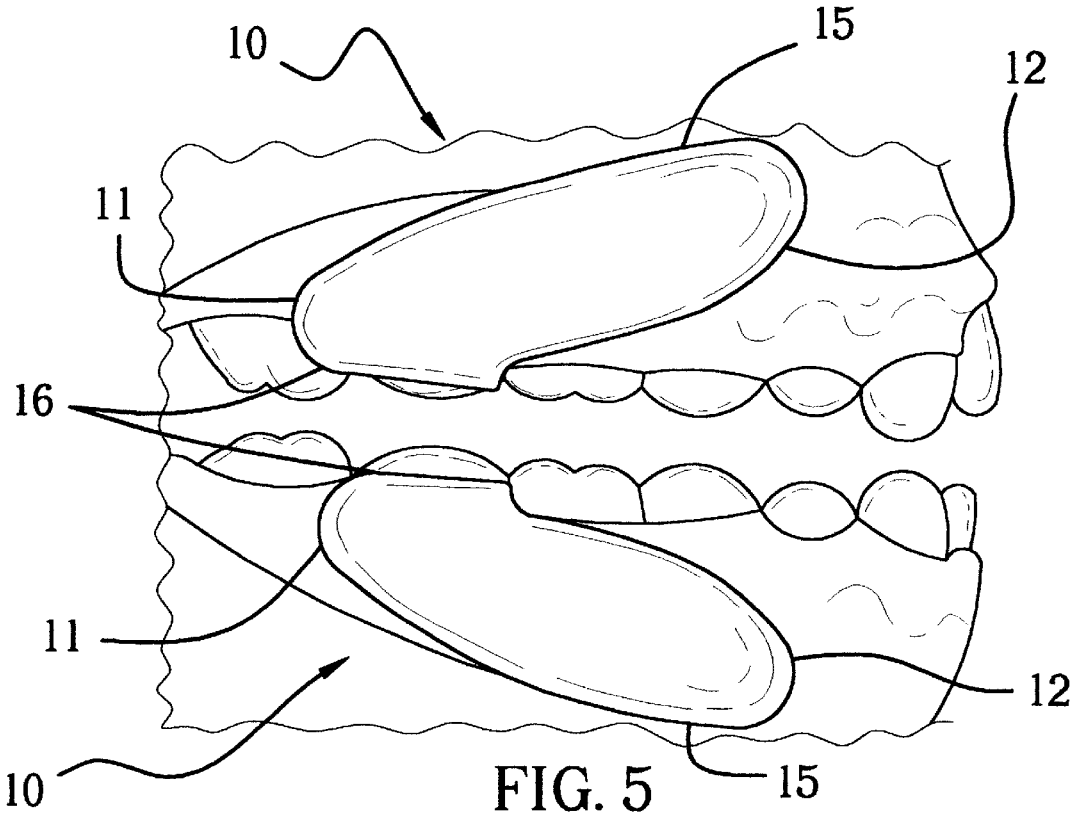
FIG. 5 is a right lateral view of a human maxilla and mandible, showing a pre-form as set out in FIG. 1, on the buccal surface of each posterior quadrant Similar reference characters refer to similar parts throughout several views of the drawings.

As best illustrated in FIG. 5, a side view shows pre-forms 10 overlying the buccal surfaces of the right maxillary and mandibular quadrants. The superior border 15 of each pre-form 10, as depicted in the oral vestibules, extends to the mucobuccal fold and no further. The inferior border 16 of each pre-form 10 extends beyond the gingival margins to the clinical crowns of the teeth, but does not reach the incisal edge of any teeth. The posterior 11 portion of each pre-form 10 is positioned in the posterior oral vestibules. The inferior 16 portion of the anterior border 12 of each pre-form 10 reaches the interdental space of the first molar and second pre-molar. Impressioning the pre-form 10 into the interdental spaces aids in securing the pre-form in position during wear. Specifically, the arcuare pre-form has a height such that when the concave interior of the pre-form is disposed over the buccal surface of the right quadrant or the left quadrant of the maxilla or the mandible, the pre-form extends superiorly no farther than the mucobuccal fold. Also, the pre-form extends inferiorly no farther than a point proximal to the incisal edges of natural or simulated teeth.

Further, the pre-form has a length such chat when the concave interior of the pre-form is disposed over the buccal surface of the right quadrant or the left quadrant of the maxilla, the pre-form extends anteriorly no farther than a midline that divides the maxilla into the right quadrant and the left quadrant. Additionally, the pre-form extends posteriorly no farther than the maxillary tuberosity of the left quadrant or the right quadrant of the maxilla.

Furthermore, the pre-form has a length such that when the concave interior of the pre-form is disposed over the buccal surface of the right quadrant or the left quadrant of the mandible, the pre-form extends anteriorly no farther than a midline that divides the mandible into the right quadrant and the left quadrant. Also, the pre-form extends posteriorly no farther than the external oblique ridge of the left quadrant or the right quadrant of the mandible. The pre-form has a width that is smaller at the anterior and posterior edges than between the anterior and posterior edges. Therefore, interposing the pre-form between a cheek and the buccal surface of the right quadrant or the left quadrant of the maxilla or the mandible stretches and reconfigures the skin of the cheek, thereby diminishing the appearance of sagging, lines, wrinkles, folds, and depressions.

As shown in the cross-sectional views (FIGS. 2A and 2B), the embodiment of the pre-form 10 is made of two materials, that are medical or food grade plastic materials. The plastic materials used to make the pre-form are solid at, or below, body temperature. However, the pre-form may be made of one medical or food grade plastic material. The pre-form has a generally concave interior that approximates the contour of a buccal surface of a posterior quadrant of a maxilla or mandible, and an exterior that is generally convex with respect to the concave interior. The pre-form of the intra-oral article has a predetermined length and height. It also has a predetermined width between the concave interior and the convex exterior. The functioning of the embodiment of the pre-form 10 of FIGS. 2A and 2B, shows the use of the two different thermoplastic materials, a first plastic material and a second plastic material. The interior surface 14 of the pre-form must have characteristics that permit impressioning of the teeth and gum of the buccal surface in a posterior quadrant, while the exterior layer 18 must simultaneously maintain its shape, whether one or two medical or food grade plastics are used.

Selection of materials for a preferred embodiment of the pre-form 10 was guided by several factors, including suitability and safety for intra-oral use, ease of customization and cost for a user, and accuracy of impressioning. These criteria pointed toward food or medical grade plastic materials, a wide variety of which are well known in the dental field and are readily available. Among these plastics are polyethylene copolymers, silicones, methylmethacrylates, and polyesters. Specifically, the field of dentistry teaches that there are a wide variety of materials that may be used for intra-oral devices, including those that can be user-customized.

Two such materials are taught by U.S. Pat. No. 5,616,027 to Jacobs et al. that describes a dual dental tray assembly with an outer (carrier) tray that is made of ethylene vinyl acetate, and an inner tray composed of a mixed material made of 67.19% polycaprolactone. When the material of Jacobs' et al. is heated and molded around a user's dentition, the inner tray is impressioned as accurately as that obtained from a dental laboratory model, and both trays can be used for multiple purposes. Ethylene vinyl acetate that is tray-shaped has been specifically used for custom mouthguards in U.S. Pat. No. 5,339,832 to Kittelsen, et al. and in dental bleaching trays as discussed in U.S. Pat. No. 5,076,791 to Madray, Jr. An equal mix of polycaprolactone and ethylene vinyl acetate is used to create a snoring and sleep apnea treatment device, which is described by Kidd, et al. in U.S. Pat. No. 5,829,441. Finally, U.S. Pat. No. 5,951,291 to Albert, et al. teaches a mixing of the base and catalyst of a room temperature-curable silicone as the fitting material for a cosmetic tooth and gum device.

By way of experimentation, the inventor selected two medical or food grade plastic materials for the preferred embodiment of the pre-form 10. The bi-layered pre-form 10 has an exterior layer 18 of ethylene vinyl acetate that has a vinyl acetate content of 25% to 40%, and an interior layer 17 of high molecular weight (30,000 to 80,000) polycaprolactone. Both materials are thermoplastics that are solid at, or below, body temperature. The polycaprolactone interior layer 17 should have a softening temperature between 110° F. to 150° F., which is well tolerated by oral tissues. The softening temperature of the exterior ethylene vinyl acetate layer 18 should be higher than the interior polycaprolactone layer 17.

In the preferred embodiment of the pre-form 10, the interior polycaprolaccone layer 17 is uniformly thick across the pre-form's 10 inferior 14 surface, with a thickness of approximately 2.3 mm to 2.7 mm. The remainder of the pre-form 10 is composed of the ethylene vinyl acetate 18 material. Depending on the molecular weight and other properties of the particular polycaprolactone selected, it can be combined with other materials to optimize its handling and impressioning characteristics. In another embodiment, having the same general appearance of the pre-form 10, of FIGS. 1–5 the exterior layer 18 and the interior layer 17 are each made of the same medical or food grade plastic, such as polycaprolactone.

To custom-fit the pre-form 10 for placement over the buccal surface to cosmeticize the human cheek, the user begins by first water-heating the pre-form 10 to a temperature that is well tolerated by oral tissues and that will sufficiently soften the pre-form's 10 interior layer 17 in preparation for custom impressioning. It is important to note that water heating will not significantly affect the exterior 13 shape or integrity of the pre-form 10. After softening, the user proceeds to fit the interior layer 17 of the pre-form 10 by positioning it against the buccal surface of a posterior quadrant of the maxilla or mandible. As the interior layer 17 cools, the pre-form 10 hardens in the mouth in about 3 to 5 minutes, at which time it can be removed. To ensure complete hardening throughout the entire thickness of the pre-form 10, it can be refrigerated briefly for about 4 to 5 minutes or left at room temperature below 78° F. for about 10 to 15 minutes.

Pre-forms 10 should be customized one at a time, preferably on the maxilla first. If a user perceives the cheek on one side to be "worse" than the other in terms of more pronounced sagging, lines, wrinkles, folds, or depressions, a pre-form 10 should be customized on that side first. If the user has more than one size of pre-forms 10, which are available, a pre-form 10 for the other side of the maxilla can be selected to provide a balanced appearance of stretching and reconfiguration of the cheek that is aesthetically pleasing to the user. Pre-forms 10 for the mandible can then be selected and custom impressioned as desired by the user. The user may also determine that wearing a maxillary pre-form 10 only on the "worse" side produces the desired effect. Mandibular pre-forms 10 serve to balance the effect produced by maxillary pre-forms 10, and they will rarely be used in the absence of a maxillary pre-form 10 on the same side. Thus, users may choose to wear from one to four pre-forms 10 to achieve the effect they desire. If more than one pre-form 10 is used, they may differ in size.

After initially customizing a pre-form 10, it can be repeatedly heated, and the interior layer 17 can be remolded or reimpressioned as necessary. Even when softened, the interior polycaprolactone layer 17 will not spontaneously separate from the exterior ethylene vinyl acetate layer 18. If necessary to achieve a better fit, however, the interior polycaprolactone layer 17 can be extended slightly beyond the pre-form's 10 borders 11, 12, 13, and 14 using gentle finger pressure when the interior layer 17 is softened. The pre-form 10 can also be scissor-trimmed. For safety, this should not be done when the pre-form 10 is in the mouth, and trimming is more easily accomplished when the pre-form 10 is slightly softened. If a small, separate piece of polycaprolactone is included with a pre-form 10, the piece can be water-heated until pliable, and molded into the incurvate portion (FIG. 3) of the anterior border 12 when the pre-form 10 is in a softened state. Users may choose to utilize this technique if teeth are missing, or for the extra security from a pre-form 10 being impressioned into another interdental space between the first and second premolars (FIG. 4).

Preferably, the pre-form 10 is available in more than one size. Due to the small variation in the size of the adult human jaw, the pre-form 10 can be manufactured with a constant length and height via suitable processes such as injection and compression molding. Using FIG. 3 as a referent, length of the inferior border 16 is approximately 2.8 to 3.2 cm, with the preferred embodiment having a length of 3.0 cm. Also, referring again to FIG. 3, the length of the superior border 15 is approximately 3.8 to 4.2 cm, with the superior border 15 of the preferred embodiment having a length of 4.0 cm. The height of the anterior 12 is about 1.8 to 2.2 cm, with the anterior height 12 of the preferred embodiment being 2.0 cm. The height of the posterior 11 is about 1.0 to 1.4 cm, with the posterior 11 height of the preferred embodiment being 1.2 cm. Since the pre-form 10 is interposed between the cheek and jaw, the extent to which the cheek is stretched and reconfigured is largely contingent upon the diameter (thickness) of a pre-form 10. Thus, the diameter is the dimension that will vary among pre-form 10 sizes. As previously mentioned, the greatest diameter of any pre-form 10 is its superior 15, posterior 11 portion (FIGS. 1, 2A, and 2B), which ranges from about 0.7 cm to 1.9 cm among sizes. Experimentation has indicated that maxillary pre-forms 10 will be sized across this full range, while mandibular pre-forms 10 will be sized in the lower half of the range.

The thermoplastic materials selected for the preferred embodiment of the pre-form 10 will not adhere to natural teeth or most dental work during impressioning, including artificial dentures. However, the softened polycaprolactone of a pre-form's 10 interior layer 17 may surround oral appliances such as braces and exposed wires, making removal of a pre-form 10 difficult after it hardens in the mouth. Therefore, pre-forms 10 should not be used over braces, and exposed wires in a posterior quadrant of the maxilla or mandible may be covered with the smallest possible piece of a material such as Saran Wrap™ prior to custom impressioning. The material can be removed from the pre-form 10 after it completely hardens, or removed from the wire immediately after the pre-form 10 is removed from the mouth. No special care is required for subsequent wearing of a hardened, customized pre-form 10, which can be applied and removed as desired. Pre-forms 10 should obviously not be impressioned or worn over oral lesions, infected areas, fresh extraction sites, etc.

The exterior 13 of the pre-form 10 is smooth, with a low coefficient of friction. This enables the cheek to slide easily over the pre-form 10 during talking, chewing, smiling, etc. Denture adhesive can be used to secure a pre-form 10 in position during wear after customization, but accurate impressioning and the inherent compression of the cheek as it rests against the exterior 13 of a pre-form 10 usually make this unnecessary.

Pre-forms 10 can be supplied in kit form, with at least one pre-form 10, written instructions for customization and use, and a container (package) for these items. The kit may also include multiple sizes of maxillary and mandibular pre-forms 10, videotaped instructions and demonstrations for customization and use, a storage container for pre-forms 10, a dipping implement for immersing a pre-form 10 into heated water, a tray onto which a pre-form 10 can be transferred after removal from heated water, small pieces of polycaprolactone for optional alteration of a pre-form's 10 anterior border 12, and adhesive for securing a pre-form 10 in place during use after custom impressioning.

It will be apparent to those skilled in the art that many modifications can be made to the preferred embodiment that has been herein described without departing from the spirit and scope of the present invention. For example, the pre-form 10 can be made without an incurvate anterior border 12, and different thermoplastic materials can be used. Also, a pre-form can be made uniformly of a single material with an interior layer 17 for impressioning added separately to pre-form 10. The added material can be a thermoplastic or thermoset (cannot be remolded after hardening) material. If a thermoplastic material that cannot maintain the exterior 13 shape of a pre-form 10 during heating is used, it can be encased in a thermal-resistant mold that covers all but the interior 14 of the pre-form 10. The pre-form 10 can then be heated in the mold, positioned in the mouth, and the mold removed from the pre-form 10 after hardening. Similarly, an intra-orally curable thermoset material can be mixed, poured into a mold of a pre-form 10, positioned in the mouth until hardened, and the mold removed. The preferred embodiment of the invention and the foregoing alternative examples can be custom impressioned on a dental model of the user instead of in the user's mouth.

Although this invention has been described in its preferred form with a certain degree of particularity with respect to an intra-oral article for stretching and reconfiguring cheek skin, it is understood that the present disclosure of the preferred form has been made only by way of example and that numerous changes in the details of structures and the composition of the combination may be resorted to without departing from the spirit and scope of the invention.

I claim:

1. An intra-oral article adapted to be disposed over a buccal surface of a right quadrant or a left quadrant of a human maxilla or a human mandible for stretching and reconfiguring cheek skin comprising:

a three sided arcuate pre-form, having a generally concave interior and an exterior that is generally convex with respect to the concave interior;

said pre-form having a height such that when said concave interior of said pre-form is adapted to be disposed over a buccal surface of a right quadrant or a left quadrant of a maxilla or a mandible, said pre-form extends superiorly no farther than a mucobuccal fold, and said pre-form extends interiorly no farther than a point proximal to incisal edges of natural or simulated teeth;

said pre-form having a length such that when said concave interior of said pre-form is adapted to be disposed over said buccal surface of said right quadrant or said left quadrant of said maxilla, said pre-form extends anteriorly no farther than a midline that divides said maxilla into said right quadrant and said left quadrant, and said pre-form extends posteriorly no farther than a maxillary tuberosity of said left quadrant or said right quadrant of said maxilla;

said pre-form having a length such that when said concave interior of said pre-form is adapted to be disposed over said buccal surface of said right quadrant or said left quadrant of said mandible, said pre-form extends anteriorly no farther than a midline that divides said mandible into said right quadrant and said left quadrant, and said pre-form extends posteriorly no farther than an external oblique ridge of said left quadrant or said right quadrant of said mandible;

said pre-form having anterior and posterior edges, with a width of said pre-form being smaller at the anterior and posterior edges than between said anterior and posterior edges;

said pre-form being solid at or below body temperature and allows for custom impressioning of said concave interior when adapted to be disposed over said buccal surface of a human maxilla or mandible; and whereby the interposing of said pre-form between a cheek and said buccal surface of said right quadrant or said left quadrant of said maxilla or said mandible, and allowing said concave interior to be disposed over said buccal surface of said right quadrant or said left quadrant of a maxilla or mandible once a negative impression is formed thereon by way of the custom impressioning thereof, and allowing the inside of said cheek to contact said convex exterior of the pre-form, will stretch and reconfigure the skin of said cheek thereby diminishing the appearance of sagging, lines, wrinkles, folds, and depressions.

2. The pre-form as set forth in claim 1, wherein said pre-form is made of one or more medical or food grade plastic materials.

3. The pre-form as set forth in claim 1, wherein said pre-form is made of a thermoplastic material.

4. The pre-form as set forth in claim 1, wherein said pre-form is made of one or more medical or food grade plastic materials selected from the group of thermoplastics consisting of polyethylene copolymers, methylmethacrylates, and polyesters.

5. The pre-form as set forth in claim 1, wherein said pre-form is made of polycaprolactone.

6. The pre-form as set forth in claim 1, wherein said pre-form is made of a thermoset material.

7. The pre-form as set forth in claim 1, wherein said pre-form is made of a silicone material.

8. The pre-form as set forth in claim 1, wherein said pre-form is bi-layered and made of a first plastic material and a second plastic material.

9. The pre-form as set forth in claim 1, wherein said first plastic material is ethylene vinyl acetate and is used as an exterior layer of said convex exterior of said pre-form.

10. The pre-form as set forth in claim 1, wherein said second plastic material is polycaprolactone and is used as an interior layer of said concave interior of said pre-form.

11. A method off cosmeticizing a human cheek comprising:

disposing a three sided arcuate intra-oral article having a generally concave interior and an exterior that is generally convex with respect to the concave interior over at least one oral structure on the buccal surface or at least one quadrant of a maxilla or mandible;

impressioning said concave interior to make the custom impression of said at least one oral structure of said buccal surface of said at least one quadrant of said maxilla or mandible;

wherein said custom impressioning of said intra-oral article will cause said intra-oral article to bear a negative impression of said at least one oral structure;

wherein said intra-oral article is of a shape such that the skin of said cheek is stretched;

whereby the stretching of said skin of said cheek diminishes the appearance of sagging, wrinkles, lines, folds, and depressions.

12. The method of cosmeticizing a human cheek as set forth in claim 11, wherein the intra-oral article is a three sided arcuate pre-form, having a generally concave interior and an exterior that is generally convex with respect to the concave interior;

said pre-form having a height such that when said concave interior of said pre-form is adapted to be disposed over a buccal surface of a right quadrant or a left quadrant of a maxilla or a mandible, said pre-form extends superiorly no farther than a mucobuccal fold, and said pre-form extends inferiorly no farther than a point proximal to incisal edges of natural or simulated teeth;

said pre-form having a length such that when said concave interior of said pre-form is adapted to be disposed over said buccal surface of said right quadrant or said left quadrant of said maxilla, said pre-form extends anteriorly no farther than a midline that divides said maxilla into said right quadrant and said left quadrant, and said pre-form extends posteriorly no farther than a maxillary tuberosity of said left quadrant or said right quadrant of said maxilla;

said pre-form having a length such that when said concave interior of said pre-form is adapted to be disposed over said buccal surface of said right quadrant or said left quadrant of said mandible, said pre-form extends anteriorly no farther than a midline that divides said mandible into said right quadrant and said left quadrant, and said pre-form extends posteriorly no farther than an external oblique ridge of said left quadrant or said right quadrant of said mandible;

said pre-form having anterior and posterior edges, with a width of said pre-form being smaller at the anterior and posterior edges than between said anterior and posterior edges;

said pre-form being solid at or below body temperature and allows for custom impressioning of said concave interior when adapted to be disposed over said buccal surface of a human maxilla or mandible; and whereby the interposing of said pre-form between a cheek and said buccal surface of said right quadrant or said left quadrant of said maxilla or said mandible, and allowing said concave interior to be disposed over said buccal surface of said right quadrant or said left quadrant of a maxilla or mandible once a negative impression is formed thereon by way of the custom impressioning thereof, and allowing the inside of said cheek to contact said convex exterior of the pre-form, will stretch and reconfigure the skin of said cheek thereby diminishing the appearance of sagging, lines, wrinkles, folds, and depressions.

13. A method of customizing a pre-form comprising the steps of:

providing means for preparing said pre-form for impressioning, such that the concave interior of said pre-form is of a predetermined consistency, wherein said consistency is such that said interior of said pre-form can bear an impression of at least one oral structure of a buccal surface of a maxilla or mandible;

disposing said concave interior of said pre-form over said at least one oral structure of said buccal surface of said maxilla or said mandible while said concave interior is of said predetermined consistency;

removing said concave interior of said pre-form from said at least one oral structure of said buccal surface of said maxilla or said mandible upon which said concave interior was disposed, after a predetermined amount of time has lapsed between said disposition and said removal;

whereby upon removal or said concave interior from said at least one oral structure of said buccal surface of said maxilla or said mandible, said concave interior of said pre-form will bear a negative impression of said at least one oral structure over which said concave interior of said pre-form was disposed; and wherein said pre-form is a three sided arcuate pre-form, having a generally concave interior and an exterior that is generally convex with respect to the concave interior;

said pre-form having a height such that when said concave interior of said pre-form is adapted to be disposed over a buccal surface of a right quadrant or a left quadrant of a maxilla or a mandible, said pre-form extends superiorly no farther than a mucobuccal fold, and said pre-form extends inferiorly no farther than a point proximal to incisal edges of natural or simulated teeth;

said pre-form having a length such that when said concave interior of said pre-form is adapted to be disposed over said buccal surface of said right quadrant or said left quadrant of said maxilla, said pre-form extends anteriorly no farther than a midline that divides said maxilla into said right quadrant and said left quadrant, and said pre-form extends posteriorly no farther than a maxillary tuberosity of said left quadrant or said right quadrant of said maxilla;

said pre-form having a length such that when said concave interior of said pre-form is adapted to be disposed over said buccal surface of said right quadrant or said left quadrant of said mandible, said pre-form extends anteriorly no farther than a midline that divides said mandible into said right quadrant and and left quadrant, and said pre-form extends posteriorly no farther than an external oblique ridge of said left quadrant or said right quadrant of said mandible;

said pre-form having anterior and posterior edges, with a width of said pre-form being smaller at the anterior and posterior edges than between said anterior and posterior edges; and said pre-form being solid at or below body temperature and allows for custom impressioning of said concave interior when adapted to be disposed over said buccal surface of a human maxilla or mandible.

14. A method of customizing the pre-form as set forth in claim 13, wherein said means for preparing said pre-form is water-heating until said concave interior of said pre-form is of a consistency such that it can bear an impression of at least one oral structure of a buccal surface of a maxilla or a mandible.

15. A kit for making the intra-oral article of claim 12 which can be customized to the needs of each end-user, said kit comprising:

at least one pre-form, or materials from which to make one pre-form, wherein said pre-form is a three sided arcuate;

said arcuate pre-form, having a generally concave interior and an exterior that is generally convex with respect to the concave interior;

said pre-form having a height such that when said concave interior of said pre-form is adapted to be disposed over a buccal surface of a right quadrant or a left quadrant of a maxilla or a mandible, said pre-form extends superiorly no farther than a mucobuccal fold, and said pre-form extends interiorly no farther than a point proximal to incisal edges of natural or simulated teeth;

said pre-form having a length such that when said concave interior of said pre-form is adapted to be disposed over said buccal surface of said right quadrant or said left quadrant of said maxilla, said pre-form extends anteriorly no farther than a midline that divides said maxilla into said right quadrant and said left quadrant, and said pre-form extends posteriorly no farther than a maxillary tuberosity of said left quadrant or said right quadrant of said maxilla;

said pre-form having a length such that when said concave interior of said pre-form is adapted to be disposed over said buccal surface of said right quadrant or said left quadrant of said mandible, said pre-form extends anteriorly no farther than a midline that divides said mandible into said right quadrant and said left quadrant, and said pre-form extends posteriorly no farther than an external oblique ridge of said left quadrant or said right quadrant of said mandible;

said pre-form having anterior and posterior edges, with a width of said pre-form being smaller at the anterior and posterior edges than between said anterior and posterior edges;

said pre-form being solid at or below body temperature and allows for custom impressioning of said concave interior when adapted to be disposed over said buccal surface of a human maxilla or mandible;

instructions for customizing said pre-form;

a container to hold said pre-form and said set of instructions; and whereby the interposing of said pre-form between a cheek and said buccal surface of said right quadrant or said left quadrant of said maxilla or said mandible, and allowing said concave interior to be disposed over said buccal surface of said right quadrant or said left quadrant of a maxilla or mandible once a negative impression is formed thereon by way of the custom impressioning thereof, and allowing the inside of said cheek to contact said convex exterior of the pre-form, will stretch and reconfigure the skin of said cheek thereby diminishing the appearance of sagging, lines, wrinkles, folds, and depressions.

* * * * *